US011185908B2

(12) United States Patent
Rotso et al.

(10) Patent No.: US 11,185,908 B2
(45) Date of Patent: Nov. 30, 2021

(54) TOOL DEVICE FOR EXPANDING THE END OF A TUBE

(71) Applicant: Uponor Innovation Ab, Virsbo (SE)

(72) Inventors: Vesa Rotso, Kukkila (FI); Mika Savolainen, Lahti (FI); Jyri Laakso, Valkeakoski (FI); Mika Uosukainen, Lahti (FI)

(73) Assignee: Uponor Innovation Ab, Virsbo (SE)

( * ) Notice: Subject to any disclaimer, the term of this patent is extended or adjusted under 35 U.S.C. 154(b) by 706 days.

(21) Appl. No.: 16/071,110

(22) PCT Filed: Jan. 24, 2017

(86) PCT No.: PCT/EP2017/051369
§ 371 (c)(1),
(2) Date: Jul. 19, 2018

(87) PCT Pub. No.: WO2017/129540
PCT Pub. Date: Aug. 3, 2017

(65) Prior Publication Data

US 2021/0170473 A1 Jun. 10, 2021

(30) Foreign Application Priority Data

Jan. 29, 2016 (FI) ..... 20165058

(51) Int. Cl.
*B21D 41/02* (2006.01)
*B21D 39/20* (2006.01)

(52) U.S. Cl.
CPC ..... *B21D 39/206* (2013.01); *B21D 41/02* (2013.01)

(58) Field of Classification Search
CPC ..... B21D 39/08; B21D 39/20; B21D 39/203; B21D 39/206; B21D 41/02; B21D 41/026; B21D 41/028; B29C 57/04; B29C 57/06
See application file for complete search history.

(56) References Cited

U.S. PATENT DOCUMENTS 3,923,952 A 12/1975 La Branche et al.
4,068,372 A 1/1978 Kamahara
(Continued)

FOREIGN PATENT DOCUMENTS

DE 102013105481 12/2014
EP 1186820 3/2002
(Continued)

OTHER PUBLICATIONS

Translation; JP 59-33040A; Michishita et al., Feb. 1984.*

*Primary Examiner* — Edward T Tolan
(74) *Attorney, Agent, or Firm* — Occhiuti & Rohlicek LLP

(57) ABSTRACT

A tool device for expanding the end of a tube (T) includes an expansion sleeve element made of elastomeric material, the expansion sleeve element being arranged concentrically around a pull rod. A calibration sleeve is arranged concentrically around the expansion sleeve element. The inner die surface of the calibration sleeve comprises a mouth portion which has a fourth diameter (d4) which corresponds with a play to the outer diameter of the tube (T), at least one expansion die portion having a fifth diameter (d5, d6) which is larger than the fourth diameter (d4), and a shoulder between the mouth portion and the expansion die portion. The shoulder keeps the end of the tube (T), while being expanded, stationary in place inside the calibration sleeve. The calibration sleeve comprises mutually openable and closable calibration sleeve parts to enable closing of the
(Continued)

calibration sleeve to a closed position (III) for the expanding operation of the end of the tube, and for opening of the calibration sleeve to an opened position (IV) for releasing the expanded end of the tube.

11 Claims, 4 Drawing Sheets

(56) References Cited

U.S. PATENT DOCUMENTS

| | | | | |
|---|---|---|---|---|
| 7,464,578 | B2 * | 12/2008 | Ayer | B25B 27/10 60/477 |
| 9,694,409 | B2 * | 7/2017 | Schellin | B21D 15/105 |

FOREIGN PATENT DOCUMENTS

| | | | | |
|---|---|---|---|---|
| GB | 639103 | | 6/1950 | |
| JP | S58173035 | | 10/1983 | |
| JP | 58-173035 | A * | 11/1983 | B21D 39/206 |
| JP | 59-33040 | A * | 2/1984 | B21D 39/206 |
| JP | S60257935 | | 12/1985 | |
| WO | WO 02/062504 | | 8/2002 | |

* cited by examiner

TOOL DEVICE FOR EXPANDING THE END OF A TUBE

CROSS-REFERENCE TO RELATED APPLICATIONS

This application is the National Stage under 35 USC 371 of International Application No. PCT/EP2017/051369, filed on Jan. 24, 2017, which claims the priority of Finnish Application No. 20165058, filed on Jan. 29, 2016. The contents of both applications are hereby incorporated by reference in their entirety.

FIELD OF THE INVENTION

The present invention relates to a tool device for expanding the end of a tube.

BACKGROUND OF THE INVENTION

In prior art, e.g. from WO02/062504, is known a tool device for expanding the end of a tube. The tool device comprises a power means to produce a pulling force. The tool device comprises a pull rod having a first end and a second end. The first end is connected to the power means, so that the power means can produce an axial motion of the pull rod between an extended position and a retracted position. The tool device further comprises a piston connected to the second end of the pull rod, the piston having a first diameter adapted to be inserted inside the tube, the piston having a first stop face. The tool device further comprises a body member having a guide channel through which the pull rod protrudes and is axially movable. The body member comprises a second stop face which is opposed to the first stop face and at a distance therefrom. The tool device further comprises an expansion sleeve element made of elastomeric material. The expansion sleeve element is arranged concentrically around the pull rod to extend in the area between the first stop face and the second stop face. The expansion sleeve element has a straight cylindrical shape with a second diameter, when the pull rod is in the extended position, and an expanded shape with a third diameter which is larger than the second diameter, when the pull rod is in the retracted position and the distance between the first stop face and second top face being shortened. The tool device further comprises a calibration sleeve, the calibration sleeve being arranged concentrically around the expansion sleeve element. The calibration sleeve comprises an inner die surface for giving a calibrated expanded form for the end of the tube while, in operation, the tube is pressed by the expanded expansion sleeve element against the die surface.

OBJECTIVE OF THE INVENTION

The objective of the invention is to provide an improved tool device.

In particular, it is an objective of the present invention to provide a tool device in which the calibration sleeve can retain the tube firmly during the expanding operation, and after the tube end has been expanded the tool device enables easy releasing of the tube from the calibration sleeve.

SUMMARY OF THE INVENTION

According to an aspect of the invention, the present invention provides a tool device for expanding the end of a tube. The tool device comprises a power means to produce a pulling force. The tool device further comprises a pull rod having a first end and a second end, the first end being connected to the power means, so that the power means can produce an axial motion of the pull rod between an extended position and a retracted position. The tool device further comprises a piston connected to the second end of the pull rod, the piston having a first diameter adapted to be inserted inside the tube, the piston having a first stop face. The tool device further comprises a body member having a guide channel through which the pull rod protrudes and is axially movable, the body member comprising a second stop face which is opposed to the first stop face and at a distance therefrom. The tool device further comprises an expansion sleeve element made of elastomeric material, the expansion sleeve element being arranged concentrically around the pull rod and extend between the first stop face and the second stop face, the expansion sleeve element having a second diameter, when the pull rod is in the extended position, and an expanded shape with a third diameter which is larger than the second diameter, when the pull rod is in the retracted position and the distance between the first stop face and second top face being shortened. The tool device further comprises a calibration sleeve, the calibration sleeve being arranged concentrically around the expansion sleeve element, the calibration sleeve comprising an inner die surface for giving a calibrated expanded form for the end of the tube while the tube is pressed by the expanded expansion sleeve element against the die surface.

According to the invention the inner die surface of the calibration sleeve comprises a mouth portion which has a fourth diameter which corresponds with a play to the outer diameter of the tube. The calibration sleeve further comprises at least one expansion die portion having a fifth diameter, which is larger than the fourth diameter. The calibration sleeve further comprises a shoulder between the mouth portion and the expansion die portion which is next to the mouth portion. The shoulder keeps the end of the tube, while being expanded, stationary and firmly in place inside the calibration sleeve. The calibration sleeve comprises mutually openable and closable calibration sleeve parts which enable closing of the calibration sleeve to a closed position for the expanding operation of the end of the tube, and for opening of the calibration sleeve to an opened position for releasing the expanded end of the tube.

The technical effect of the invention is that, due to the shoulder formed in the inner die surface, the calibration sleeve retains the tube stationary in relation to the calibration sleeve so that no mutual slipping can occur during expansion of the expansion sleeve to press the tube end against the inner die surface of the calibration sleeve element. The pivotally openable calibration sleeve allows the tube end to be easily released from the grip of the calibration sleeve.

In an embodiment of the tool device the calibration sleeve comprises a first calibration sleeve part and a second calibration sleeve part, and a lock device for locking the calibration sleeve parts in a closed position. The number of the calibration sleeve parts is, however, not limited to two, but the calibration sleeve may consist of three, four or more parts.

In an embodiment of the tool device the expansion sleeve element has a first end and a second end. The first end is in abutment with and fixedly attached to the first stop face.

In an embodiment of the tool device in the extended position of the pull rod the second end of the expansion sleeve element is at a distance from the second stop face, so that a clearance is formed between the second end and the second stop face. A cyclic compression and reversing of the expansion sleeve element which is repeated thousands of times can cause fatigue in the elastomeric material so that the expansion sleeve element does not reverse to its original length and diameter anymore. The technical effect of the clearance between the second end of the expansion sleeve and the second stop face is that it allows an elongation of the expansion sleeve element by the effect of friction force between the outer surface of the expansion sleeve element and the inner surface of the tube end when the tube is pushed on the expansion sleeve.

In an embodiment of the tool device the second end of the expansion sleeve element is fixedly connected in relation to the second stop face, and that in the extended position of the pull rod the expansion sleeve element is in a stretched state under tensile stress. The technical effect of this alternative solution is that the expansion sleeve is forced to a predetermined original length and diameter in order to eliminate the abovementioned effect of fatigue of the elastomeric material.

In an embodiment of the tool device the first end of the expansion sleeve element is loosely in relation to the first stop face and the second end of the expansion sleeve element is loosely in relation to the second stop face.

In an embodiment of the tool device the second stop face has a frustoconical shape, the second stop face comprising a flat cap face surrounded by a conical slope surface. The technical effect is that the frustoconical shape controls the expansion of the expansion sleeve element by guiding "the flow" of elastomeric material during its expansion when it is compressed. Alternatively, the second stop face may have other shapes than frustoconical, e.g. flat, or the second stop face can include a groove.

In an embodiment of the tool device the flat cap face has a sixth diameter which corresponds to the second diameter of the expansion sleeve element.

In an embodiment of the tool device the first calibration sleeve part comprises a first pivot arm which is pivoted to be turnable about a pivot hinge axle, and the second calibration sleeve part comprises a second pivot arm which is pivoted to be turnable about the same pivot hinge axle as the first pivot arm, that the pivot hinge axle is at a distance from the center axis of the pull rod.

In an embodiment of the tool device the lock device comprises a latch pin which is guided movable between a locking position and a release position at the outer periphery of the first calibration sleeve part, the latch pin being spring-loaded by a pressure spring towards the locking position. The lock device further comprises a retaining notch at the outer periphery of the second calibration sleeve part. The retaining notch is arranged to receive and retain the latch pin in the locking position. The lock device further comprises a double-arm release lever pivoted about a pivot point to the first calibration sleeve part. The double-arm release lever comprises a first arm part, which is in connection with the latch pin, and a second arm part which is longer than the first arm part for grabbing by the operator and for turning the first arm part around the pivot point to move the latch pin to the release position against the spring force of the pressure spring.

In an embodiment of the tool device the expansion sleeve element is made of elastomeric material having hardness of 60 to 100 Shore A.

In an embodiment of the tool device the expansion sleeve element is made of thermoplastic polyurethane.

In an embodiment of the tool device the power means is a hydraulic cylinder to produce the movement of the pull rod.

In an embodiment of the tool device the tool device is a handheld tool device comprising a handle.

In an embodiment of the tool device the handle includes a rechargable battery, a hydraulic pump to produce hydraulic pressure for the hydraulic cylinder, an electric motor for driving the hydraulic pump and an on-off switch which can be operated by the operator to control the operation of the tool device.

It is to be understood that the aspects and embodiments of the invention described above may be used in any combination with each other. Several of the aspects and embodiments may be combined together to form a further embodiment of the invention.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION OF THE INVENTION

Figure 2:
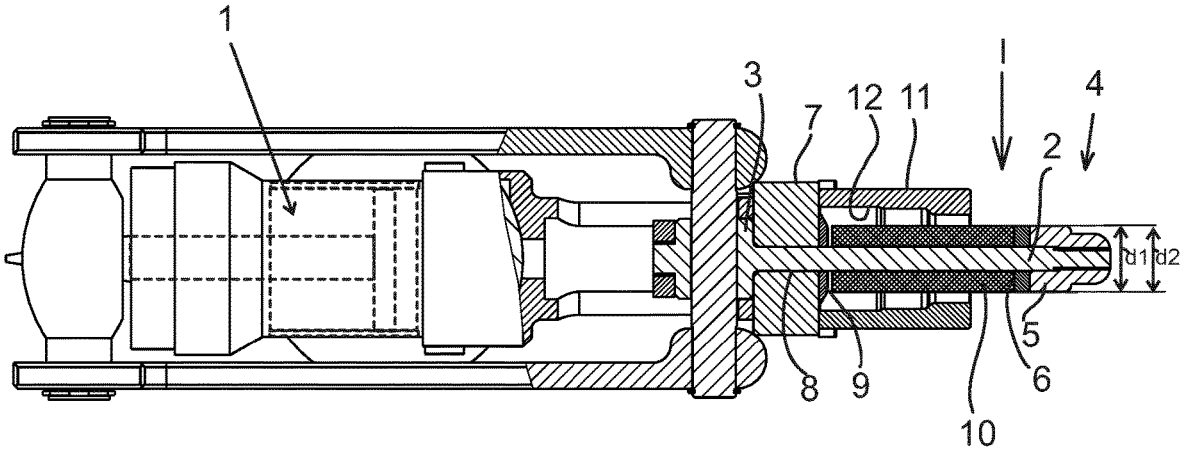
FIG. 2 shows the tool device of FIG. 1 from above and sectioned partially.
Figure 3:
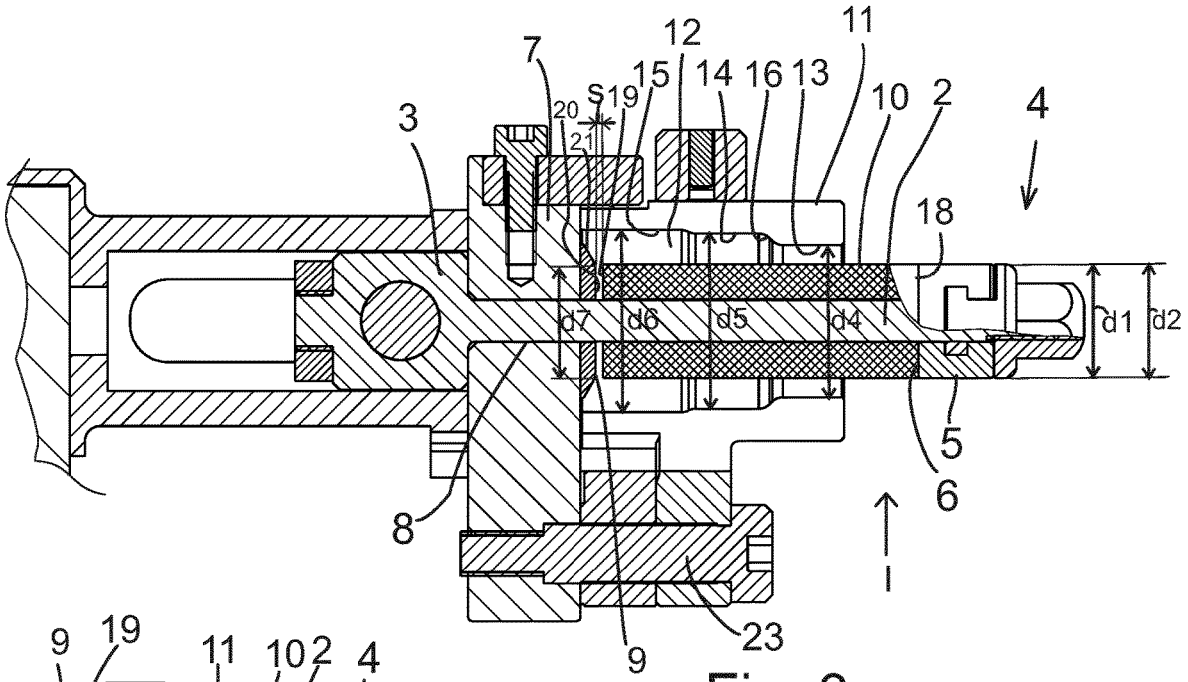
FIG. 3 shows a partial cross-section of the tool device of FIG. 1.
Figure 4:
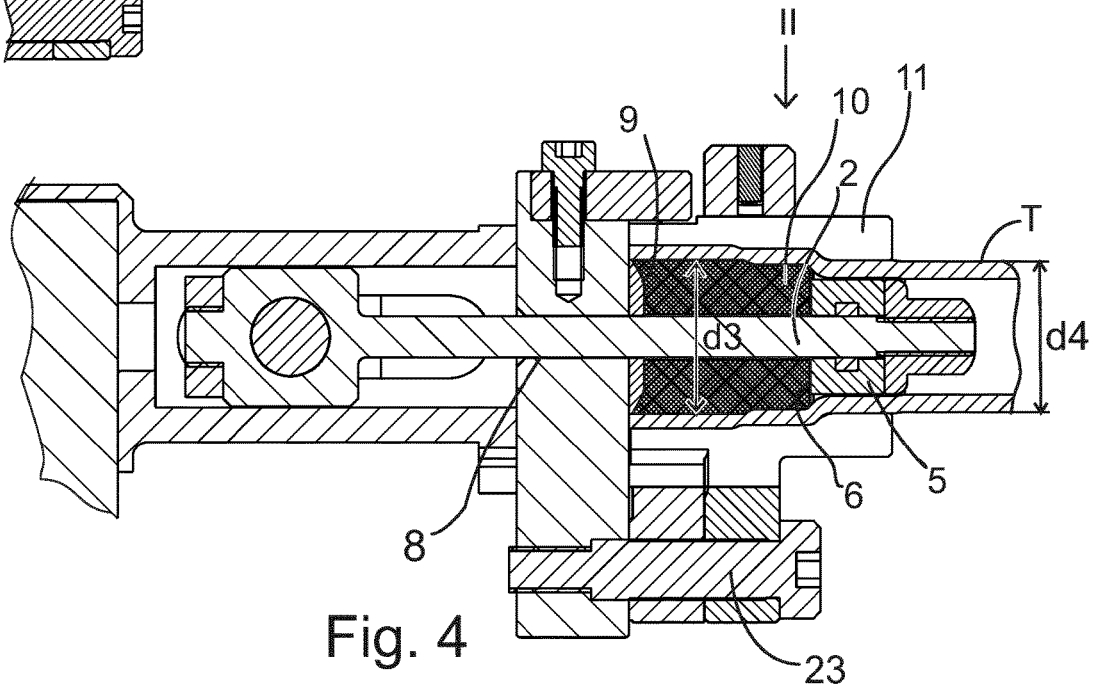
FIG. 4 shows the tool device of FIG. 4 when the pull rod is in a retracted position the expansion sleeve element being in a compressed state and expanded to expand the end of the tube by pressing it against the calibration sleeve.

FIGS. 1 to 7 shows a tool device for expanding the end of a tube T (see FIG. 4). The tool device is designed and especially suitable for expanding the ends of pipes used in plumbing applications, such as PEX pipes (crosslinked polyethylene pipes). PEX material has an active memory capacity, and seamless aluminium composite pipe). Seamless aluminium composite pipe is built up from two concentric plastic layers with an intermediate seamless layer of aluminium and all these three layers are attached to each other by adhesive layers. However, there are commercial composite pipes comprising layers of metal, plastic and adhesives between these layers. Most of these provided pipes have a seam in metal layer or are of the structure of where the metal layer overlaps and is then welded. These pipes are not suitable for expanding, because the seam may be defected when expanding. This defection of the seam may cause inconsistency in the pipe wall and thus cause leakages. The tool device is also suitable for expanding the ends of metal pipes, such as copper pipes.

Figure 1:
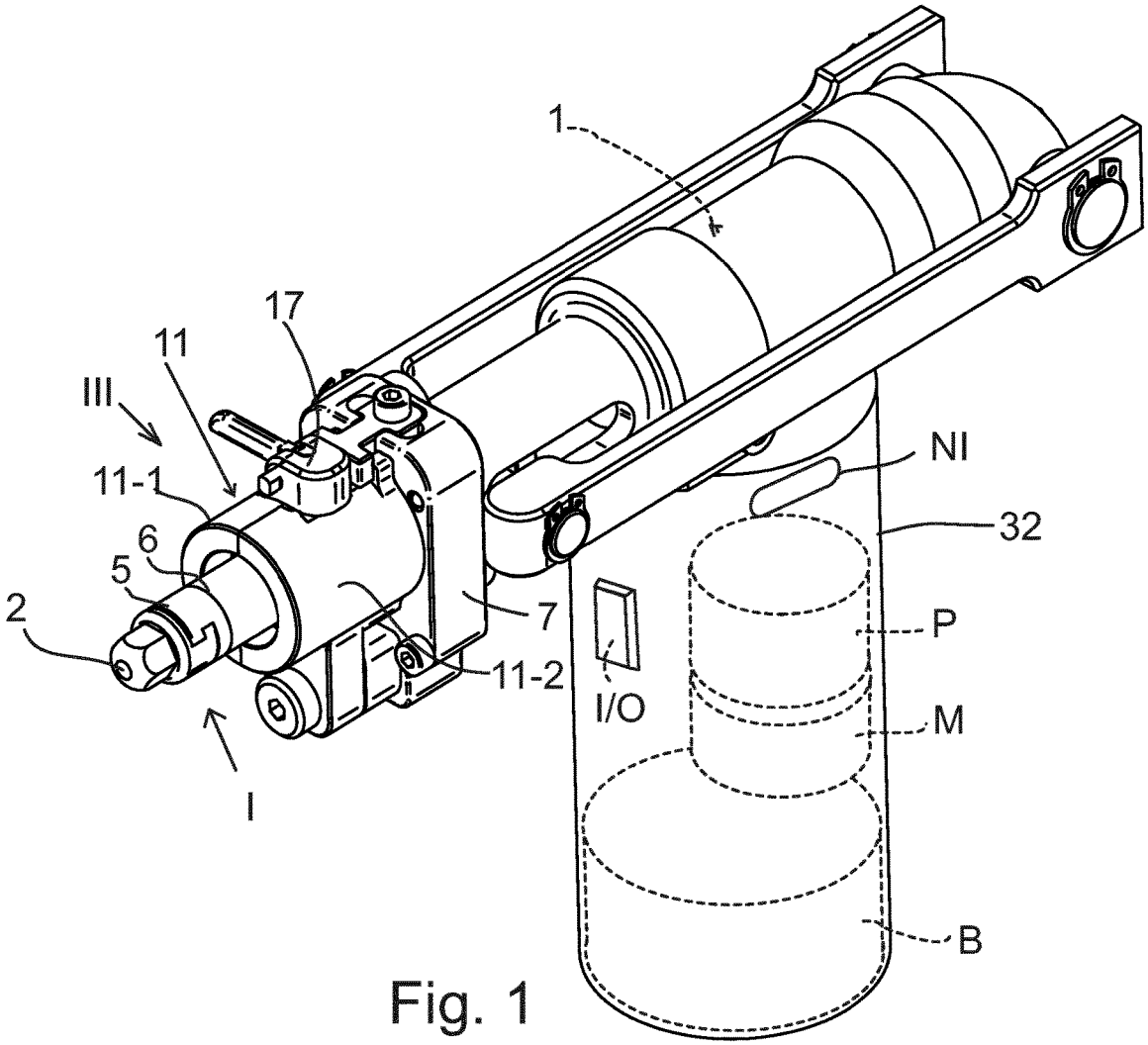
FIG. 1 shows an axonometric view of the tool device according to one embodiment of the invention.

By reference to FIG. 1, the tool device is preferably a handheld power tool having a handle 32 by which the operator can hold the tool device by hand to perform the expansion operation. The tool device comprises a power means 1 to produce a pulling force. As shown in FIG. 2, the power means 1 can be for example a hydraulic cylinder 1 whereby the handle 32 may contain equipment such as a rechargeable battery B, a hydraulic pump P to produce hydraulic pressure for the hydraulic cylinder 1, an electric motor M for driving the hydraulic pump P and an on-off switch I/O, which can be operated by the operator to control the operation of the tool device. Although this example shows a hydraulic cylinder as a power means, it should be noted that any suitable power means can be used to produce the pulling action. The tool device may also have a number indicator NI which is visible to the operator and shows the number of working cycles and thereby indicates how many times the expansion sleeve has been compressed for its expansion. This may indicate when the change of the expansion sleeve element needs to be done.

The tool device comprises a pull rod 2 having a first end 3 and a second end 4. The first end 3 is connected to the power means 1, so that the power means 1 can produce a linear axial motion of the pull rod 2 between an extended position I (see FIGS. 1-3 and 5) and a retracted position II (see FIG. 4).

A piston 5 is connected to the second end 4 of the pull rod 2. Referring to FIGS. 2 and 3, the piston 5 has a first diameter d1 adapted to be inserted inside the tube the end of which is supposed to be expanded. The piston 5 has a first stop face 6.

The tool device further comprises a body member 7. As shown in FIGS. 2-4, the body member 7 has a guide channel 8 through which the pull rod 2 protrudes and is axially movable. The body member 7 comprises a second stop face 9 which is opposed to the first stop face 6 and at a distance therefrom.

An expansion sleeve element 10 made of elastomeric material is arranged concentrically around the pull rod 2. The expansion sleeve element 19 extends in the area between the first stop face 6 and the second stop face 9.

As shown in FIGS. 2 and 3, the expansion sleeve element 10 is an axially symmetrical sleeve and has a straight cylindrical shape, although the shape of the expansion sleeve element is not limited to cylindrical; for example in some other not shown embodiment the expansion sleeve element can be conical. The expansion sleeve element has a second diameter d2, when the pull rod 2 is in the extended position I. As shown in FIG. 4, in the compressed state the expansion sleeve element 10 has an expanded shape with a third diameter d3 which is larger than the second diameter, when the pull rod 2 is in the retracted position II, the distance between the first stop face 6 and second top face 9 being shortened.

A calibration sleeve 11 is arranged concentrically around the expansion sleeve element 10. The calibration sleeve 11 comprises an inner die surface 12 for giving a calibrated expanded form for the end of the tube T while the tube is pressed by the expanded expansion sleeve element 10 against the die surface 12, as shown in FIG. 4.

With reference to FIG. 3, the inner die surface 12 of the calibration sleeve 11 comprises a mouth portion which has a fourth diameter d4 which corresponds with a play to the outer diameter of the tube T. The inner die surface 12 further comprises at least one expansion die portion 14, 15 having a fifth diameter d5, d6 which is larger than the fourth diameter d4 of the mouth portion 13. In this example there are two expansion die portions, i.e. a first expansion die portion 14 having the diameter d5 and a second expansion die portion 15 having the diameter d6. The expansion die portion(s) can have any desirable shape, i.e. it can be cylindrical or even barrel-shaped.

A shoulder 16 is a rounded transition area between the mouth portion 13 and the expansion die portion 14 which is next to the mouth portion 13. The shoulder 16 keeps the end of the tube T, while being expanded by the expansion sleeve, firmly and stationary in place inside the calibration sleeve 11 so that the tube T does not escape from inside the calibration sleeve.

As can be seen in FIGS. 1 and 5-7, the calibration sleeve 11 comprises mutually openable and closable calibration sleeve parts 11-1, 11-2 which are pivotally connected to the body member 7. The pivotal connection enables closing of the calibration sleeve parts to a closed position III for the expanding operation of the end of the tube, and for opening of the calibration sleeve parts to an opened position IV for releasing the expanded end of the tube T. The calibration sleeve 7 is splitted in the axial direction into two halves which are a first calibration sleeve part 11-1 and a second calibration sleeve part 11-2. A lock device 17 is arranged for locking the calibration sleeve parts 11-1 and 11-2 in a closed position.

Figure 6:
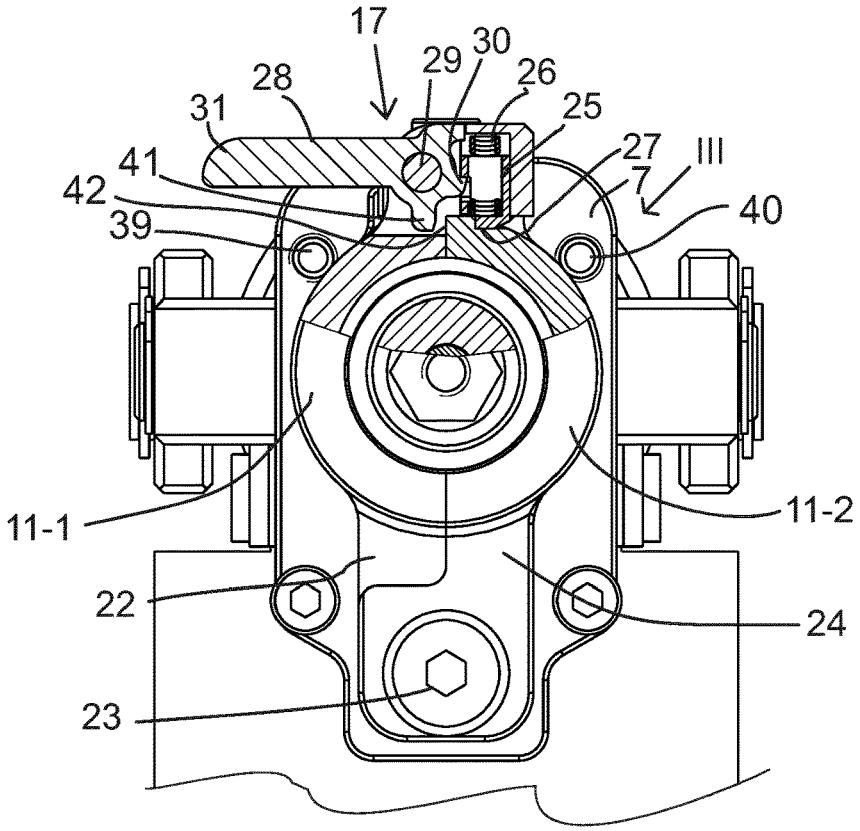
FIG. 6 shows a front view of the tool device of FIG. 1 sectioned partially.
Figure 7:
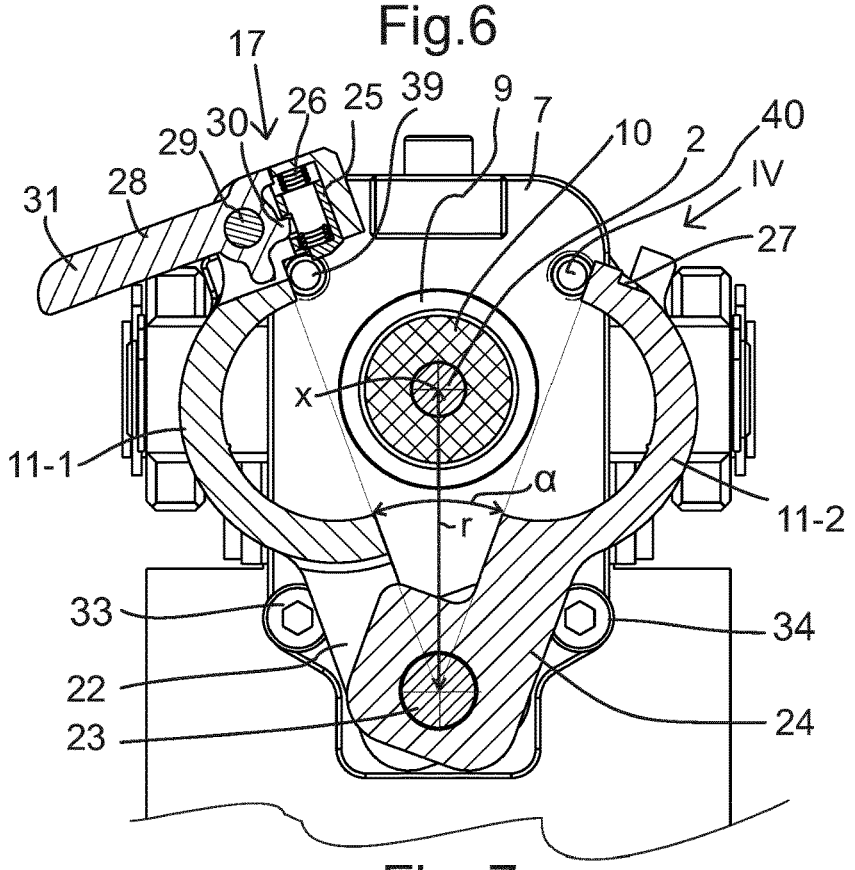
FIG. 7 shows the tool device of FIG. 6 the calibration sleeve parts being in an opened position.

As can be seen in FIGS. 6 and 7, the first calibration sleeve part 11-1 comprises a first pivot arm 22. The first pivot arm 22 is pivoted to be turnable about a pivot hinge axle 23. The second calibration sleeve part 11-2 comprises a second pivot arm 24 which is pivoted to be turnable about the same pivot hinge axle 23 as the first pivot arm 22. The pivot hinge axle 23 is at a distance r from the center axis x of the pull rod 2. As can be seen in FIGS. 1, 3-5, the pivot hinge axle 23 is a bolt which is threaded to a bolt hole which is in the body member 7. The mutual opening angle $\alpha$ of the first pivot arm 22 and the second pivot arm 24 is limited to an acute angle by stop members 33 and 34. The first calibration sleeve part 11-1 and the second calibration sleeve part 11-2 are held in the opened position IV by retainers 39, 40 which come into contact with the calibration sleeve parts as they are opened towards the opened position IV. The retainers 39, 40 can be for example spring plungers which are threaded into threaded holes made in the body member 7.

As can be seen in FIGS. 6 and 7, the lock device 17 comprises a latch pin 25 which is guided movable between a locking position and a release position in a guide formed at the outer periphery of the first calibration sleeve part 11-1. The latch pin 25 is spring-loaded by a pressure spring 26 towards the locking position. A retaining notch 27 is formed at the outer periphery of the second calibration sleeve part 11-2. The retaining notch 27 is arranged to receive and retain the latch pin 25 in the locking position. A double-arm release lever 28 is pivoted about a pivot point 29 at the first calibration sleeve part 11-1. The double-arm release lever 28 comprises a first arm part 30, which is in connection with the latch pin 25, and a second arm part 31 which is longer than the first arm part 30. The double-arm release lever 28 also comprises a pushing cam 41 which is adapted to hit a counter surface 42 formed in the second calibration sleeve part 11-2. The operator can release the lock device 17 by grabbing the second arm part 31 with his fingers and press it downwards whereby the first arm part 30 turns about the pivot point 29 and lifts the latch pin 25 against the spring force of the pressure spring 26 out from contact to the retaining notch 27 to the release position. Simultaneously, the pushing cam 41 pushes the counter surface 42 and assists in separating of the calibration sleeve parts from each other.

Referring back to FIG. 3, the expansion sleeve element 10 has a first end 18 and a second end 19, the first end 18 being in abutment with and fixedly attached to the first stop face 6. In the extended position I of the pull rod 2 the second end 19 of the expansion sleeve element 10 is at a distance from the second stop face 9, so that a clearance s is formed between the second end 19 and the second stop face 9.

Figure 3A:
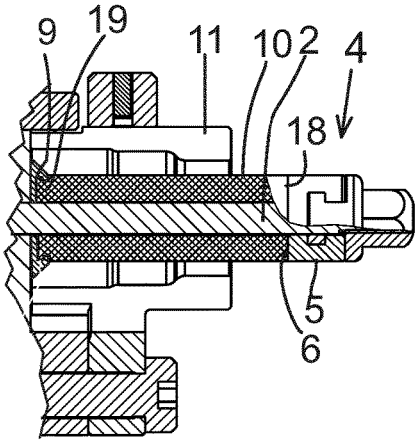
FIG. 3*a* shows an alternative detail for the tool device of FIG. 3.

FIG. 3*a* shows an alternative solution, wherein the second end 19 of the expansion sleeve element 10 is fixedly connected in relation to the second stop face 9. In the extended position II of the pull rod 2 the expansion sleeve element 10 is in a stretched state under tensile stress.

As can be seen in FIGS. 3 and 4, the second stop face 9 has a frustoconical shape. The second stop face 9 comprises a flat cap face 20 surrounded by a conical slope surface 21. The flat cap face 20 has a sixth diameter d7 which corresponds to the second diameter d2 of the expansion sleeve element 10. The expansion sleeve element 10 is made of elastomeric material having hardness of 60 to 100 Shore A. The expansion sleeve element 10 is can e.g. be made of thermoplastic polyurethane.

Figure 5:
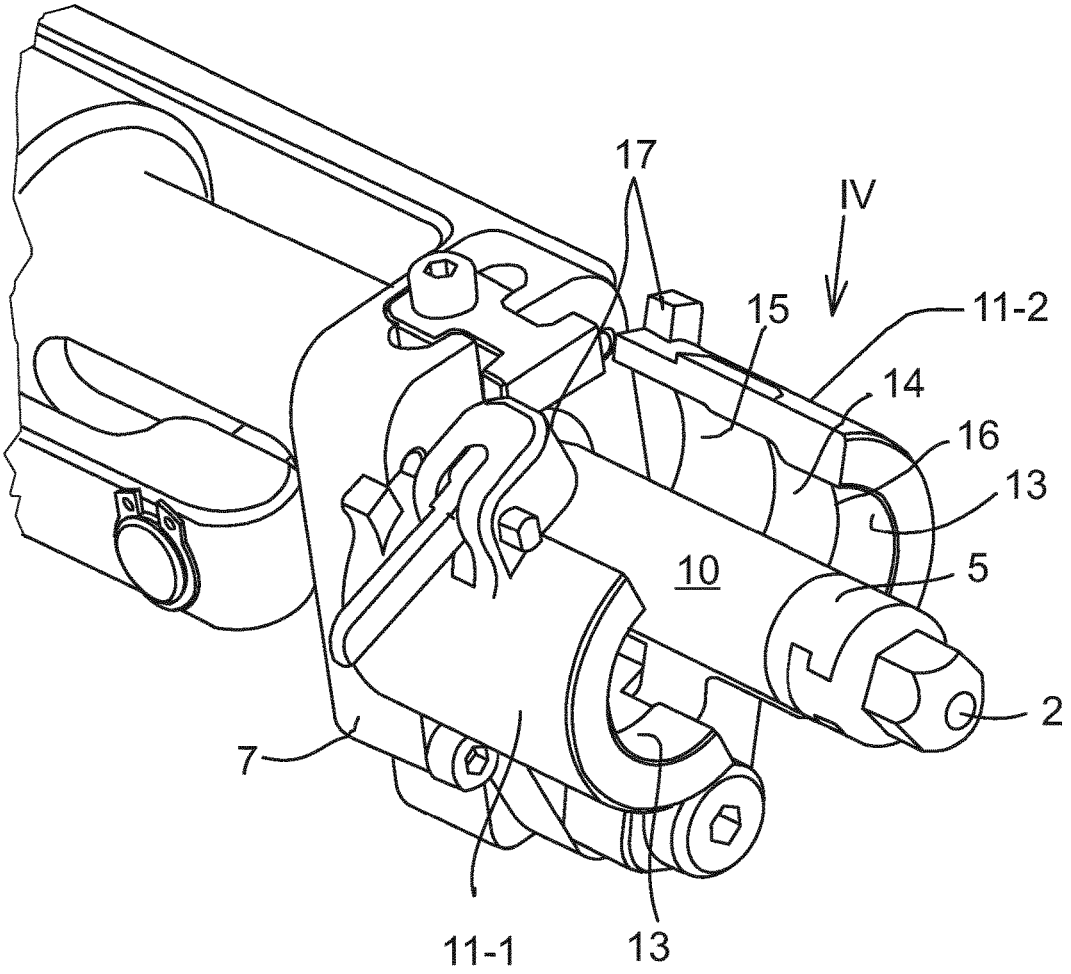
FIG. 5 shows an axonometric view of the tool device of FIG. 1 the calibration sleeve parts being in an opened position.
Figure 5A:
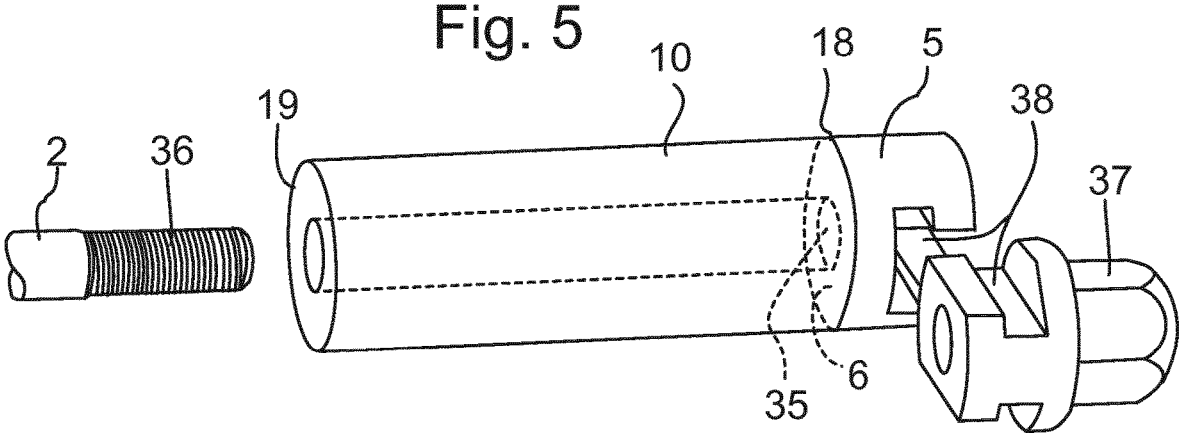
FIG. 5*a* shows the expansion sleeve element of the tool device of FIG. 5 being detached from the pull rod.

FIG. 5*a* shows the expansion sleeve element 10 as detached from the pull rod 2. The expansion sleeve element 10 has a first end 18 and a second end 19. The first end 18 is in abutment with and fixedly attached to the first stop face 6 of the piston 5. The piston 5 is a piece made of metal or plastics and fixed by gluing or by overmolding to the first end 18 of the expansion sleeve element 10. Overmolding is an injection molding process where one material is molded onto a second material. When properly selected, the overmolded material will form a strong bond with the second material. The piston 5 has a central through-hole 35, through which the threaded end 36 of the pull rod 2 can protrude so that a nut 37 can be threaded to the threaded end 36. The piston 5 and the nut 37 are connected to each other by a sliding dovetailed joint 38 or like.

It is obvious to a person skilled in the art that with the advancement of technology, the basic idea of the invention may be implemented in various ways. The invention and its embodiments are thus not limited to the examples described above, instead they may vary within the scope of the claims.

The invention claimed is:

1. A tool device for expanding the end of a tube (T), the tool device comprising a power means to produce a pulling force, a pull rod having a first end and a second end, the first end being connected to the power means, so that the power means can produce an axial motion of the pull rod between an extended position (I) and a retracted position (II), a piston connected to the second end of the pull rod, the piston having a first diameter (d1) adapted to be inserted inside the tube (T), the piston having a first stop face, a body member having a guide channel through which the pull rod protrudes and is axially movable, the body member comprising a second stop face which is opposed to the first stop face and at a distance therefrom, an expansion sleeve element made of elastomeric material, the expansion sleeve element being arranged concentrically around the pull rod and extend between the first stop face and the second stop face, the expansion sleeve element having a second diameter (d2), when the pull rod is in the extended position (I), and an expanded shape with a third diameter (d3) which is larger than the second diameter, when the pull rod is in the retracted position (II) and the distance between the first stop face and second top face being shortened, and a calibration sleeve, the calibration sleeve being arranged concentrically around the expansion sleeve element, the calibration sleeve comprising an inner die surface for giving a calibrated expanded form for the end of the tube (T) while the tube is pressed by the expanded expansion sleeve element against the die surface, wherein the inner die surface of the calibration sleeve comprises a mouth portion which has a fourth diameter (d4) which corresponds with a play to the outer diameter of the tube (T), at least one expansion die portion having a fifth diameter (d5, d6) which is larger than the fourth diameter (d4), and a shoulder between the mouth portion and the expansion die portion which is next to the mouth portion, whereby the shoulder keeps the end of the tube (T), while being expanded, stationary in place inside the calibration sleeve;

wherein the calibration sleeve comprises mutually openable and closable calibration sleeve parts comprising a first calibration sleeve part and a second calibration sleeve part to enable closing of the calibration sleeve to a closed position (III) for the expanding operation of the end of the tube, and for opening of the calibration sleeve to an opened position (IV) for releasing the expanded end of the tube;

wherein the calibration sleeve comprises a lock device for locking the calibration sleeve parts in a closed position;

wherein the expansion sleeve element has a first end and a second end, the first end being in abutment with and fixedly attached to the first stop face; and the second end of the expansion sleeve element is fixedly connected in relation to the second stop face, and that in the extended position (II) of the pull rod the expansion sleeve element is in a stretched state under tensile stress.

2. The tool device according to claim 1, wherein the second stop face has a frustoconical shape, the second stop face comprising a flat cap face surrounded by a conical slope surface.

3. The tool device according to claim 2, wherein the flat cap face has a sixth diameter (d7) which corresponds to the second diameter (d2) of the expansion sleeve element.

4. The tool device according to claim 2, wherein the first calibration sleeve part comprises a first pivot arm which is pivoted to be turnable about a pivot hinge axle, and the second calibration sleeve part comprises a second pivot arm which is pivoted to be turnable about the same pivot hinge axle as the first pivot arm, that the pivot hinge axle is at a distance (r) from the center axis (x) of the pull rod.

5. The tool device according to claim 4, wherein the lock device comprises a latch pin which is guided movable between a locking position and a release position at the outer periphery of the first calibration sleeve part, the latch pin being spring-loaded by a pressure spring towards the locking position, a retaining notch at the outer periphery of the second calibration sleeve part, the retaining notch being arranged to receive and retain the latch pin in the locking position, and a double-arm release lever pivoted about a pivot point to the first calibration sleeve part, the double-arm release lever comprising a first arm part, which is in connection with the latch pin, and a second arm part which is longer than the first arm part for grabbing by the operator and for turning the first arm part around the pivot point to move the latch pin to the release position against the spring force of the pressure spring.

6. The tool device according to claim 1, wherein the expansion sleeve element is made of elastomeric material having hardness of 60 to 100 Shore A.

7. The tool device according to claim 1, wherein the expansion sleeve element is made of thermoplastic polyurethane.

8. The tool device according to claim 1, wherein the power means is a hydraulic cylinder to produce the movement of the pull rod.

9. The tool device according to claim 1, wherein the tool device is a handheld tool device comprising a handle.

10. The tool device according to claim 9, wherein the handle includes a rechargeable battery (B), a hydraulic pump (P) to produce hydraulic pressure for the hydraulic cylinder, an electric motor (M) for driving the hydraulic pump and an on-off switch (I/O) which can be operated by the operator to control the operation of the tool device.

11. The tool device according to claim 1, wherein the expansion sleeve element is changeable.

* * * * *